US008156845B2

(12) United States Patent
Lin

(10) Patent No.: US 8,156,845 B2
(45) Date of Patent: Apr. 17, 2012

(54) WRENCH

(75) Inventor: Chun-Lang Lin, Dali (TW)

(73) Assignee: Advance Team Power Inc., Taichung (TW)

( * ) Notice: Subject to any disclaimer, the term of this patent is extended or adjusted under 35 U.S.C. 154(b) by 317 days.

(21) Appl. No.: 12/692,605

(22) Filed: Jan. 23, 2010

(65) Prior Publication Data

US 2011/0179913 A1 Jul. 28, 2011

(51) Int. Cl.
*B25B 13/46* (2006.01)
*B25B 23/16* (2006.01)

(52) U.S. Cl. ..... 81/62; 81/177.8

(58) Field of Classification Search ..... 81/62, 177.8, 81/177.9, 58, 58.1
See application file for complete search history.

(56) References Cited

U.S. PATENT DOCUMENTS 5,941,141 A * 8/1999 Whitley ..... 81/63.1
6,032,555 A * 3/2000 Whitley ..... 81/63.1
6,216,565 B1 * 4/2001 McCann ..... 81/177.8
6,752,048 B1 * 6/2004 Chiang ..... 81/63.1
6,928,904 B2 * 8/2005 Hsien ..... 81/60
6,993,998 B1 * 2/2006 Kao et al. ..... 81/60
7,302,876 B1 * 12/2007 Lee ..... 81/177.9
2005/0016332 A1 * 1/2005 Hu ..... 81/177.8
2006/0137491 A1 * 6/2006 Chen ..... 81/58
2007/0034058 A1 * 2/2007 Chen ..... 81/58
2007/0074607 A1 * 4/2007 Balls ..... 81/62

* cited by examiner

*Primary Examiner* — David B Thomas
(74) *Attorney, Agent, or Firm* — Wang Law Firm, Inc.; Li K. Wang

(57) ABSTRACT

A wrench includes a driving head, an axle hole formed at an end of the driving head, an accommodating portion disposed in the axle hole for accommodating pawls, a control ring contained in the axle hole and having an end extended out of the axle hole and coupled to a wrench handle, and a ratchet section and a smooth section defined on an external periphery of the control ring, and the ratchet section is provided for latching the pawls to define a fixed state of latching the wrench handle with the driving head and can be rotated into a secured status, and the smooth section is provided for pushing the pawls to release the fixed state of latching the control ring, so as to allow the wrench handle to be turned with respect to the driving head for a quick rotation.

7 Claims, 7 Drawing Sheets

WRENCH

BACKGROUND OF THE INVENTION

1. Field of the Invention

The present invention relates to a wrench, and more particularly to a wrench structure having a driving head that can be rotated with respect to a wrench handle.

2. Description of the Related Art

With reference to FIG. 7 for a conventional quick-rotating wrench structure, the structure comprises a driving head 91 and a wrench handle 92 coupled with the driving head 91, wherein the driving head 91 includes an axle hole 93 having internal ratchets, an axle seat 94 formed at an end that connects the wrench handle 92 and the driving head 91, an accommodating slot 95 separately formed at the middle and both sides of the axle seat 94 for accommodating a push button 96 and a latch teeth 97 that can be latched with the internal ratchets of the axle hole 93.

However, the manufacture of the aforementioned quick-rotating wrench structure requires manufacturing additional internal ratchets on the axle hole 93 of the driving head 91 and the axle seat 94 having the plurality of accommodating slots 95 on the wrench handle 92, and thus incurring a more complicated manufacturing procedure, a longer manufacturing time and a higher manufacturing cost. Furthermore, the plurality of accommodating slots 95 are formed at the axle seat 94 of the wrench handle 92 used for connecting the axle hole 93, and thus the structural strength of the wrench handle 92 is decreased and the wrench handle 92 cannot bear a large change of stresses, and the latch teeth 97 pushed by the push button 96 to latch the internal ratchets of the axle hole 93 provides a relatively poor fixing effect. If a larger turning force is applied to the wrench, the latch teeth 97 will be unable to securely latch the internal ratchets of the axle hole 93.

In view of the shortcomings of the prior art, the inventor of the present invention based on years of experience in the related industry to conduct extensive researches and experiments, and finally developed a wrench in accordance with the present invention to overcome the shortcomings of the prior art.

SUMMARY OF THE INVENTION

Therefore, it is a primary objective of the present invention to overcome the aforementioned shortcoming and deficiency of the prior art by providing a wrench with the advantages of a simple structure, an easy installation, a low manufacturing cost, and a simple, easy and quick operation.

To achieve the foregoing objective, the present invention provides a wrench comprising:

a driving head, having a moving portion disposed at an end of the driving head, an axle hole formed at another end of the driving head, an accommodating portion concavely disposed on a side of an internal wall of the axle hole, two adjacent pawls accommodated in the accommodating portion and separately abutted by a first elastic element to provide a clamping force towards the axle hole;

a control ring, contained in the axle hole, and having a connecting end extended upwardly out of the axle hole and coupled with a wrench handle, and a ratchet section and a smooth section defined on an external circumferential surface of the control ring, and the ratchet section of the control ring being latched by the two pawls to define a fixed state of the control ring; and a prop column, passed into the control ring, and an end of the prop column being extended upwardly and passed out of the connecting end of the control ring to form a press portion, such that a user can use the press portion as a fulcrum to apply a force to move the wrench handle and the control ring with respect to the driving head, and the two pawls are pushed by the smooth section of the control ring to release the fixed state of latching the ratchet section of the control ring.

The aforementioned and other objectives and technical characteristics of the present invention will become apparent with the detailed description of the preferred embodiments and the illustration of related drawings as follows.

DETAILED DESCRIPTION OF THE PREFERRED EMBODIMENTS

Figure 1:
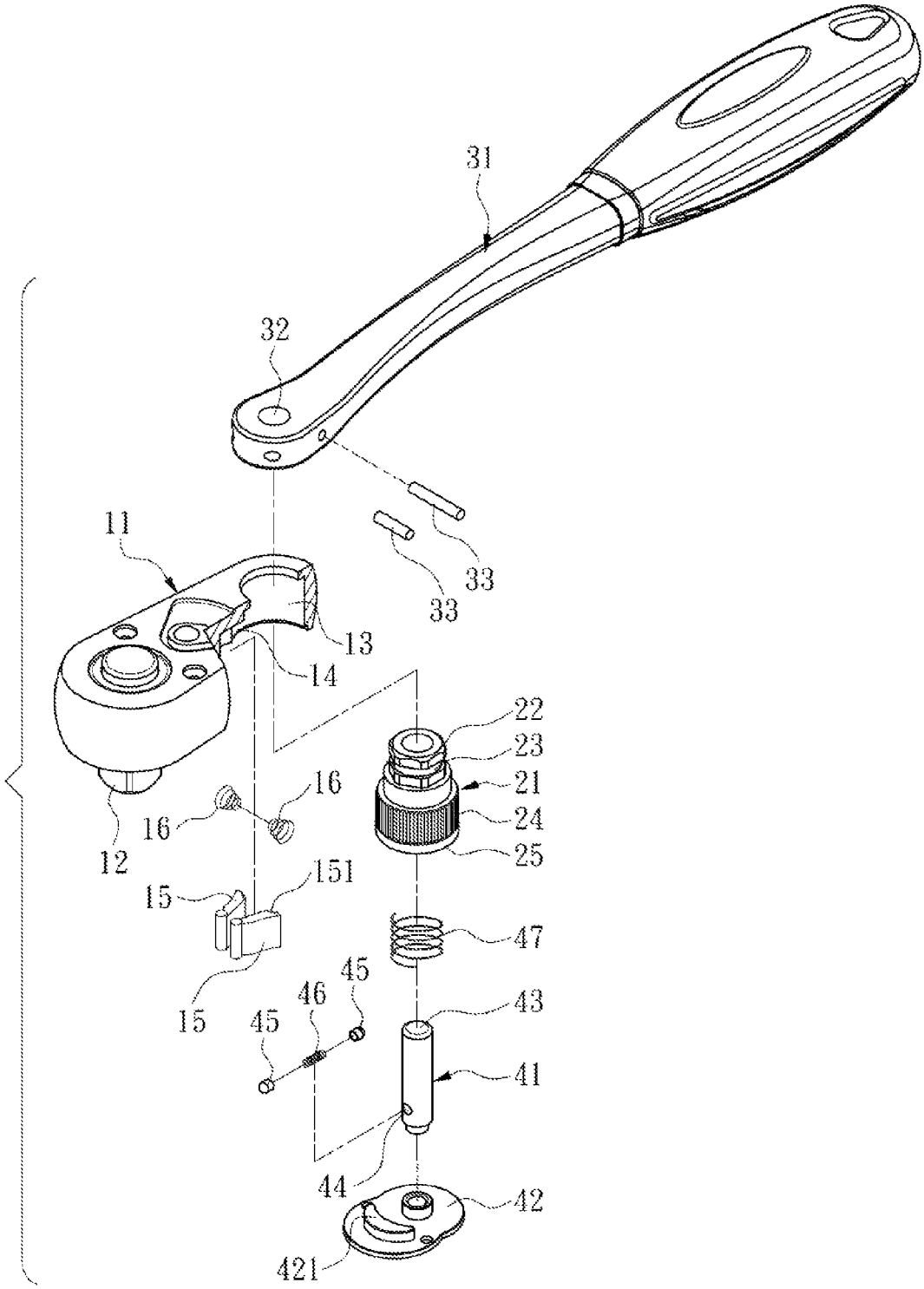
FIG. 1 is an exploded view of a wrench of the present invention.
Figure 2:
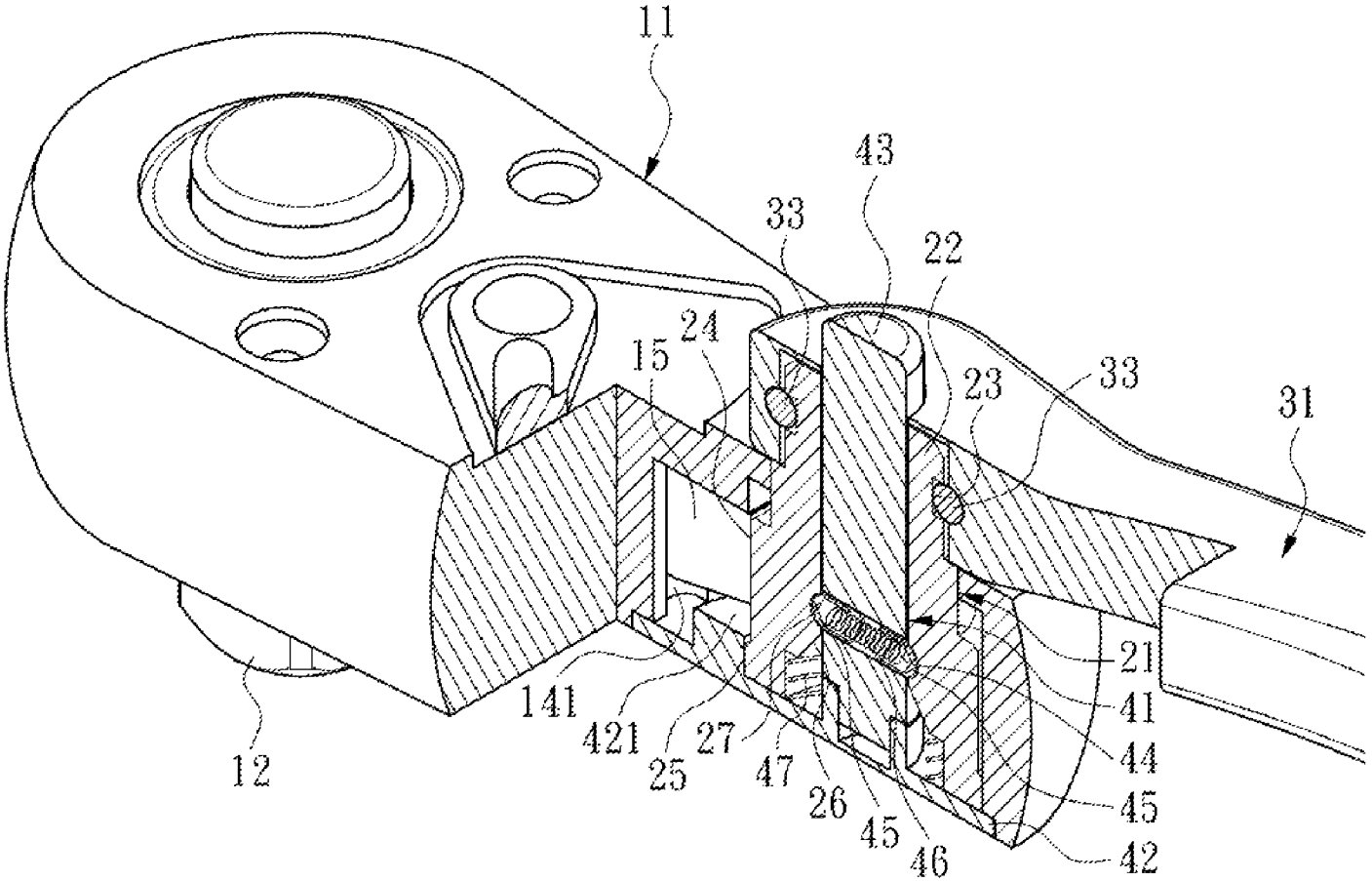
FIG. 2 is a perspective view of a wrench of the present invention.

With reference to FIGS. 1 to 4 for a wrench of the present invention, the wrench comprises a driving head 11, a control ring 21, a wrench handle 31 and a prop column 41.

The driving head 11 includes a moving portion 12 disposed at an end of the driving head 11 for driving a workpiece to rotate, an axle hole 13 penetrating through another end of the driving head 11, an accommodating portion 14 concavely disposed on a side of an internal wall of the axle hole 13, and two adjacent pawls 15 contained in the accommodating portion 14 and elastically abutted by a first elastic element 16, such that the two pawls 15 have a clamping force towards the axle hole 13. In this preferred embodiment, the accommodating portion 14 further have two grooves 141 concavely disposed thereon, and ends of the two pawls 15 are respectively and pivotally coupled into the two grooves 141, and the two pawls 15 have brake teeth 151 extended from other ends of the two pawls 15 in a direction towards the axle hole 13, and an end of each first elastic element 16 abuts against the accommodating portion 14, and another end of each first elastic element abuts against a side of the corresponding pawl 15 without the brake teeth 151, such that the two pawls 15 can have a clamping action towards the axle hole 13.

The control ring 21 is a hollow ring disposed in the axle hole 13, and the control ring 21 includes a connecting end 22 extended upwardly out of the axle hole 13, and the connecting end 22 has a positioning slot 23, and a ratchet section 24 and a smooth section 25 defined on an external circumferential surface of the control ring 21, wherein the smooth section 25 has an external diameter greater than the external diameter of the ratchet section 24, and the ratchet section 24 of the control ring 21 is latched with the brake teeth 151 of the two pawls 15, such that the control ring 21 is fixed, and the smooth section 25 of the control ring 21 is provided for pushing the two pawls 15 to release the fixed state of the ratchet section 24 of the control ring 21. In addition, a tapered neck 26 and a positioning recession 27 are defined sequentially from bottom to top and disposed at predetermined positions of an internal wall of the control ring 21 respectively.

The wrench handle 31 includes a penetrating hole 32 formed at an end of the wrench handle 31, and the wrench handle 31 is sheathed onto the connecting end 22 of the control ring 21 through the penetrating hole 32, and two fixing pins 33 are passed through the wrench handle 31 and into the positioning slot 23 of the connecting end 22 respectively, such that the wrench handle 31 is coupled and linked with the control ring 21.

The prop column 41 is passed into an internal wall of the control ring 21, and the control ring 21 can be moved up and down along the prop column 41. In this preferred embodiment, the prop column 41 is tapered downwardly to an end to form a base 42, and the prop column 41 is fixed to the bottom of the axle hole 13 of the driving head 11 by the base 42, and a stop portion 421 is protruded from the base 42 and accommodated into the bottom of the accommodating portion 14, such that when the prop column 41 is fixed to the bottom of the axle hole 13 of the driving head 11 by the base 42, the stop portion 421 of the base 42 and the top of the accommodating portion 14 are provided for stopping the two pawls 15 to prevent the two pawls 15 from being separated from the accommodating portion 14, and an upper end of the prop column 41 is passed out of the connecting end 22 of the control ring 21 and exposed from the penetrating hole 32 of the wrench handle 31 to form a press portion 43, such that users can use the press portion 43 as a fulcrum to apply a force to move the wrench handle 31 with respect to the driving head 11. Now, the wrench handle 31 will drive the control ring 21 to move upward synchronously, and the smooth section 25 of the control ring 21 is moved to an opposite position of the two pawls 15, such that the two pawls 15 are pushed by the smooth section 25 to release the fixed state of the ratchet section 24 of the control ring 21, and a through hole 44 radially penetrates through a body of the prop column 41, and two positioning blocks 45 installed in opposite directions with each other are contained in the through hole 44, and a second elastic element 46 is installed between the two positioning blocks 45, and a third elastic element 47 is installed between the base 42 and the control ring 21, wherein the second elastic element 46 provides the two positioning blocks 45 an elastic force towards the internal wall of the control ring 21. When the ratchet section 24 of the control ring 21 and the brake teeth 151 of the two pawls 15 are latched to define a fixed state, the two positioning blocks 45 are latched to a tapered neck 26 of the internal wall of the control ring 21, so as to provide a positioning effect to the control ring 21. When the control ring 21 is driven by the wrench handle 31 to move upward synchronously to release the fixed state of latching the ratchet section 24 with the two pawls 15, the two positioning blocks 45 are latched to a positioning recession 27 on the internal wall of the control ring 21 to provide the positioning effect as well.

Figure 3:
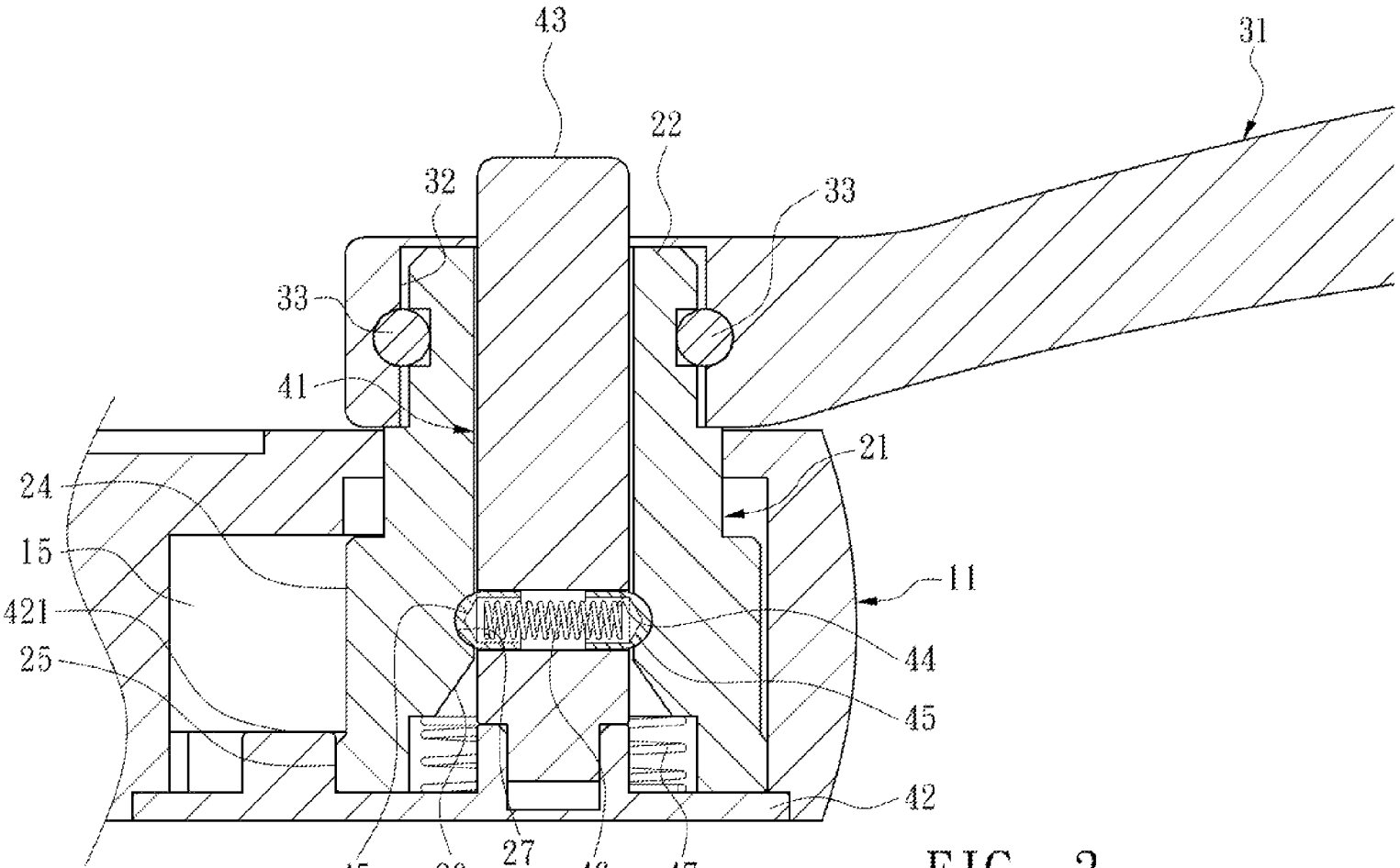
FIG. 3 is a cross-sectional view of a wrench of the present invention.
Figure 4:
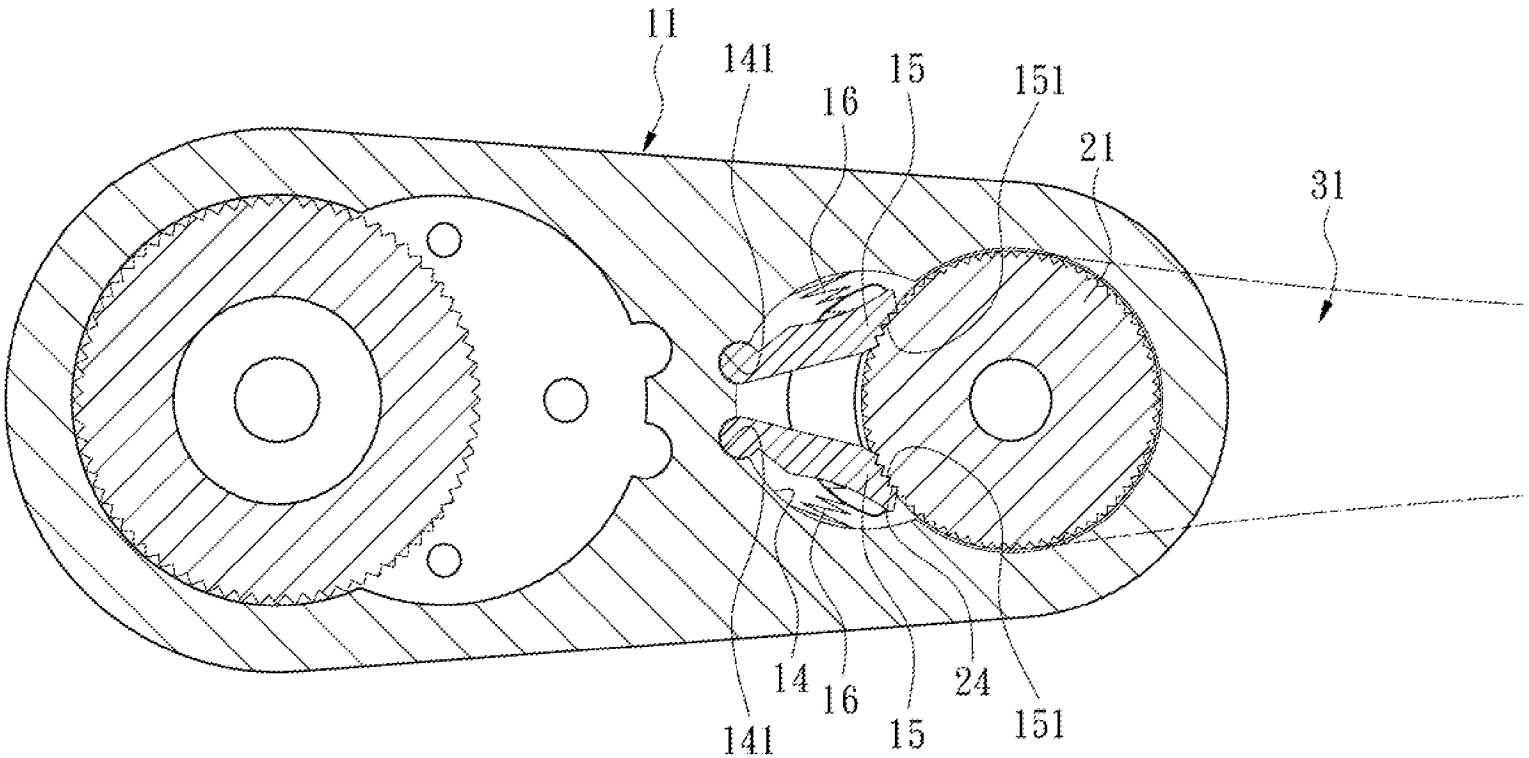
FIG. 4 is another cross-sectional view of a wrench of the present invention.

With reference to FIGS. 3 and 4 for cross-sectional views of a wrench of the present invention showing a status of latching the ratchet section 24 of the control ring 21 with the brake teeth 151 of the two pawls 15, the driving head 11 and the wrench handle 31 are fixed, and the third elastic element 47 installed between the base 42 of the prop column 41 and the control ring 21 is compressed, and the two positioning blocks 45 are latched into the positioning recession 26 on the internal wall of the control ring 21, and the elastic force of the second elastic element 46 for elastically abutting the two positioning blocks 45 is greater than the resilient force produced by the third elastic element 47, such that the control ring 21 is positioned and latched to the two pawls 15 at a fixed position, and a larger turning force can be applied to the wrench at the fixed state for its application.

Figure 5:
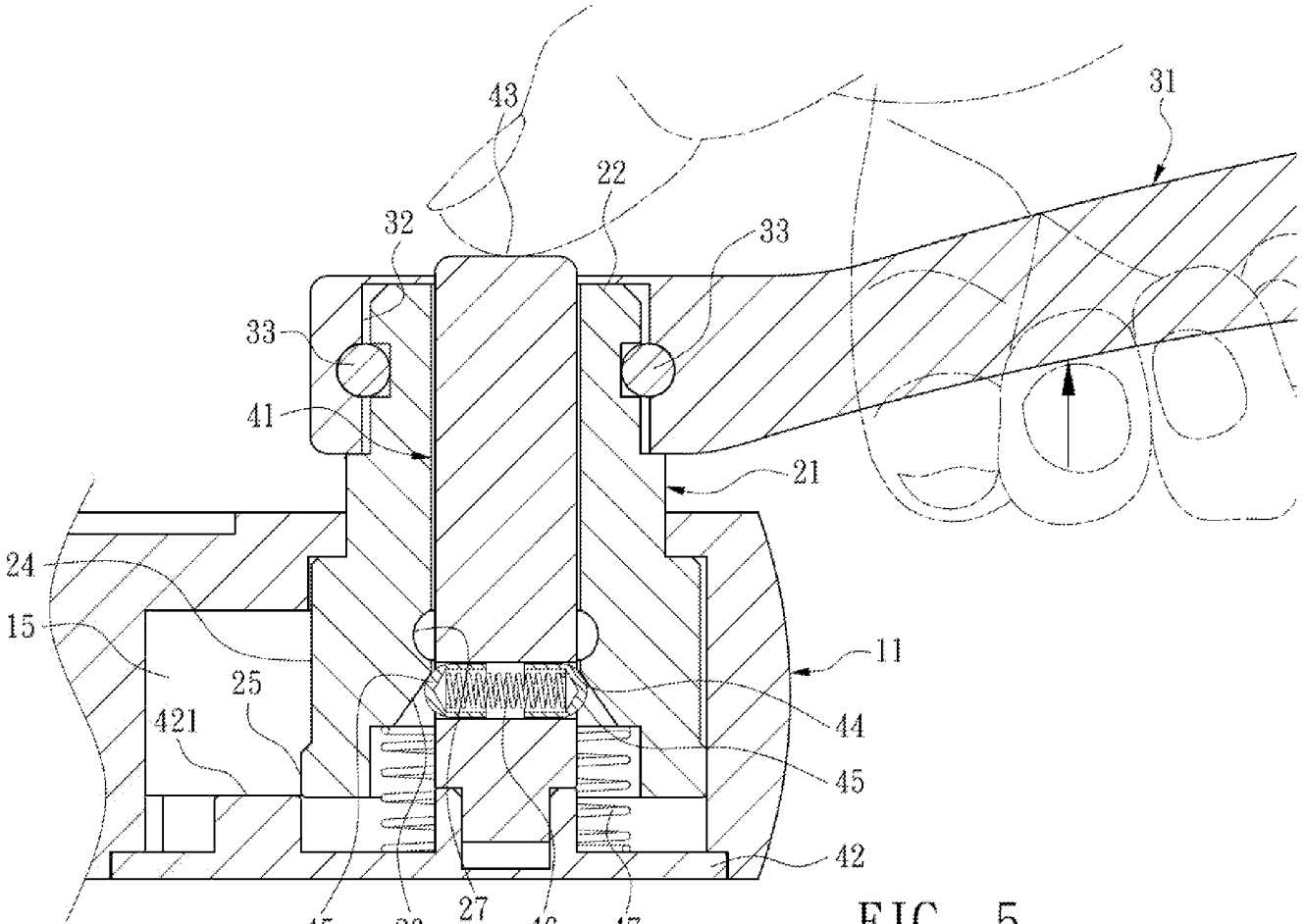
FIG. 5 is a schematic view of an application of a wrench in accordance with the present invention.
Figure 6:
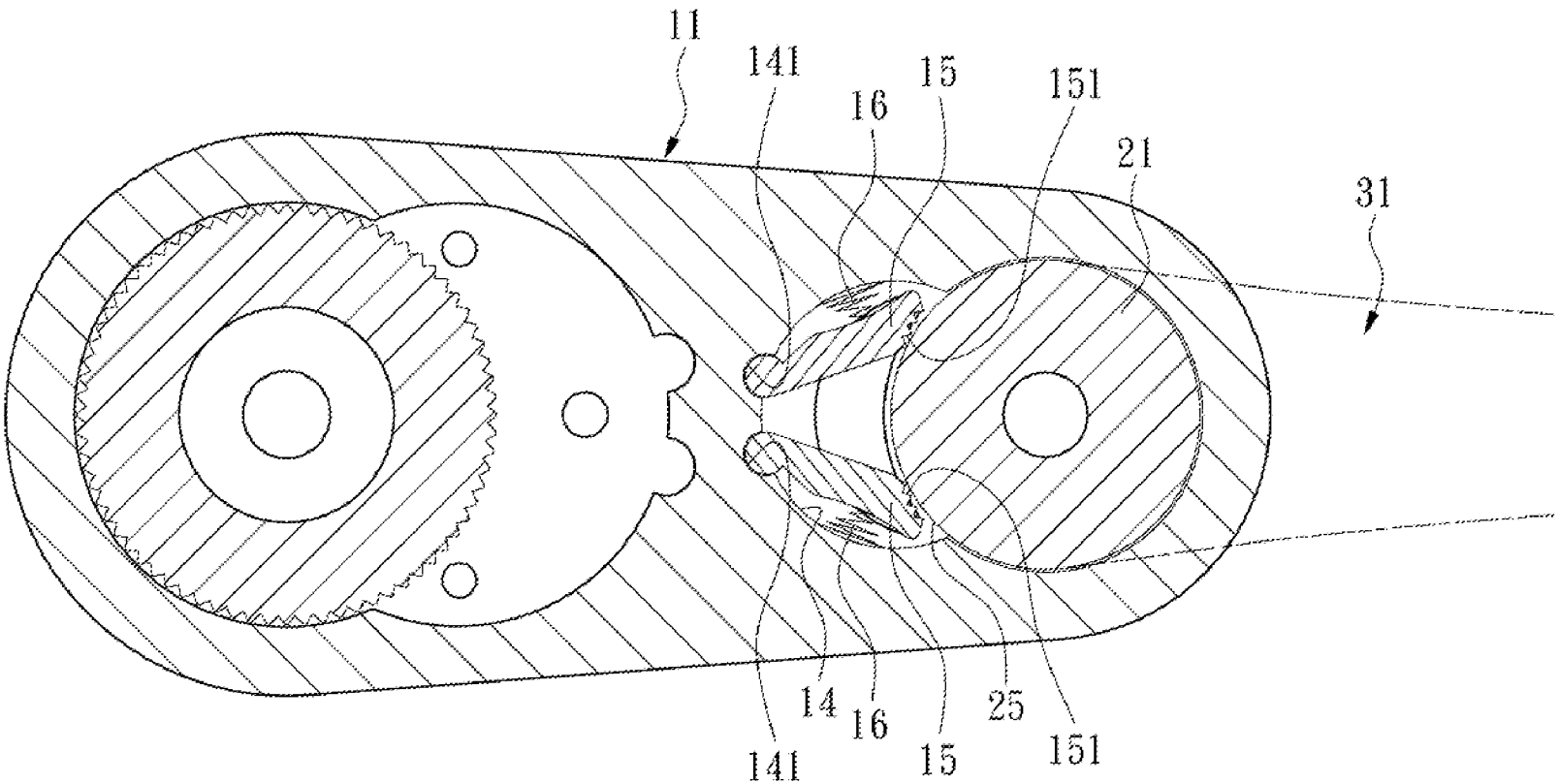
FIG. 6 is a cross-sectional view of FIG. 5.
Figure 7:
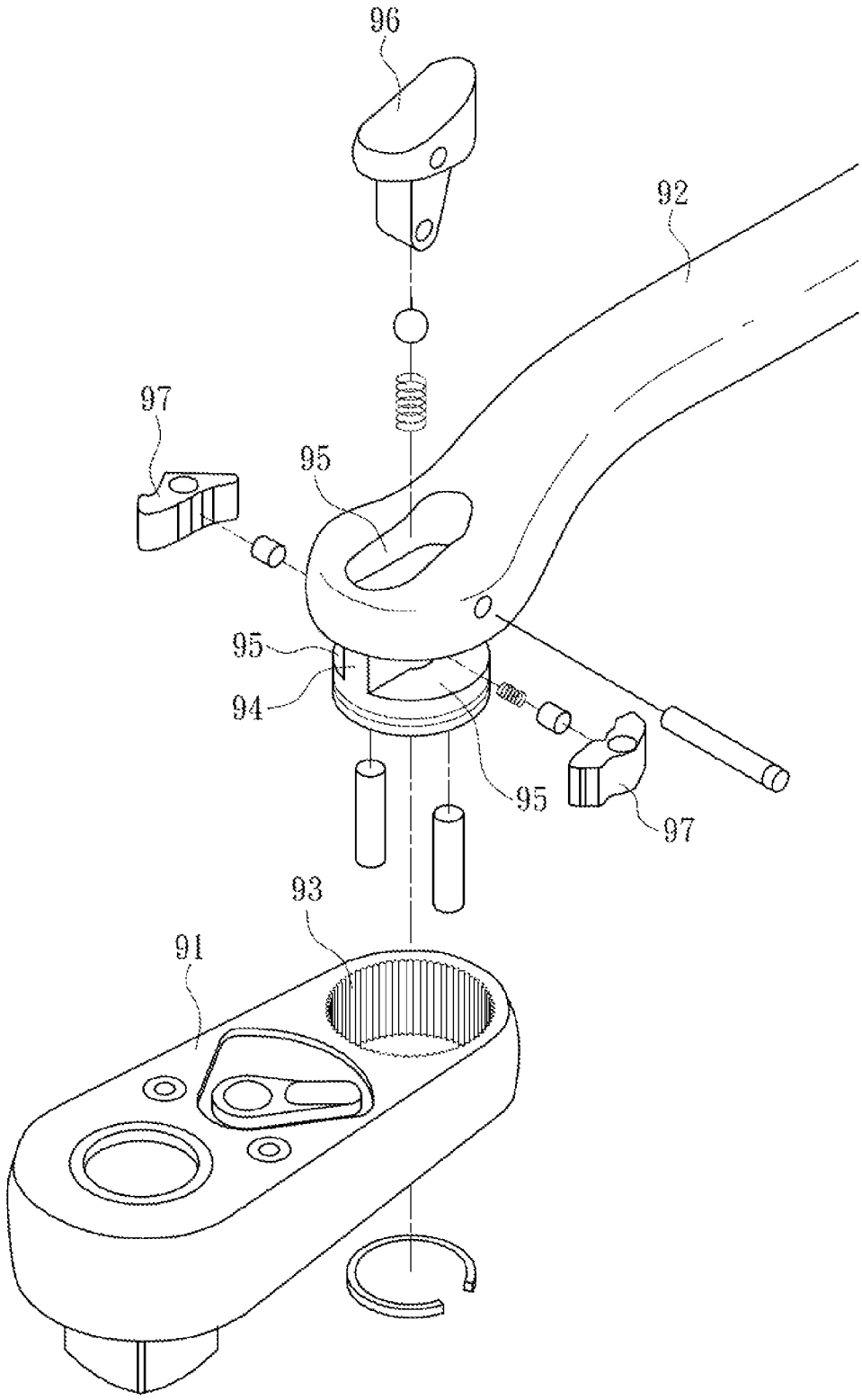
FIG. 7 is a schematic view of a conventional wrench structure.

If a user holds the wrench handle 31 by a hand and uses the press portion 43 of the prop column 41 as a fulcrum to apply a force to move the wrench handle 31 upward, and the applied force is greater than the elastic force provided by the second elastic element 46, the two positioning blocks 45 will be forced to retract and release the effect of positioning the control ring 21, such that the wrench handle 31 drives the control ring 21 to move upward with respect to the driving head 11. In FIGS. 5 and 6, if the control ring 21 is moved upward with respect to the driving head 11, the smooth section 25 of the control ring 21 will push the two pawls 15 to compress the two first elastic elements 16 to move backward respectively, so as to release the fixed state of latching the brake teeth 151 of the two pawls 15 with the ratchet section 24 of the control ring 21. If the tapered neck 26 of the internal wall of the control ring 21 is moved to a position opposite to the two positioning blocks 45, the two positioning blocks 45 will be abutted against the tapered neck 26 of the internal wall of the control ring 21 to fix the control ring 21 at a position. Since the control ring 21 is not latched or fixed by the two pawls 15 now, the wrench handle 31 can be turned to a quick rotation with respect to the driving head 11.

If the user wants to return the control ring 21 to the fixed state, the user simply needs to press the wrench handle 31 down to overcome the elastic force provided by the second elastic element 46 in order to force the two positioning blocks 45 to retract and release the positioning effect. When the smooth section 25 of the control ring 21 is moved downward to leave the position opposite to the two pawls 15, the two pawls 15 are propped by the first elastic element 16 to resume the fixed state of latching the ratchet section of the control ring 21 as shown in FIG. 3.

In summation of the description above, the two pawls 15 of the present invention are abutted by the two first elastic elements 16 respectively, such that the brake teeth 151 can be latched directly to the ratchet section 24 of the control ring 21 to provide a more secured fixing effect, and the wrench structure of the present invention is a simple structure with the advantages of a better structural strength, an easy assembling and a low manufacturing cost, and the wrench of the present invention provides a simple, easy and quick operation. Obviously, the present invention improves over the prior art and complies with patent application requirements, and thus is duly filed for the patent application.

While the invention has been described by device of specific embodiments, numerous modifications and variations could be made thereto by those generally skilled in the art without departing from the scope and spirit of the invention set forth in the claims.

What is claimed is:

1. A wrench, comprising:

a driving head, having a moving portion disposed at an end of the driving head, an axle hole formed at another end of the driving head, an accommodating portion concavely disposed on a side of an internal wall of the axle hole, and two adjacent pawls accommodated in the accommodating portion and separately and elastically abutted by a first elastic element and having a clamping force towards the axle hole;

a control ring, contained in the axle hole, and having a connecting end extended upwardly out of the axle hole and coupled and linked with a wrench handle, and a ratchet section and a smooth section defined on an external circumferential surface of the control ring, and the ratchet section of the control ring and the two pawls being latched to the control ring to define a fixed state;

a prop column, passed into the control ring, and an end of the prop column being extended upward and passed out of the connecting end of the control ring to form a press portion, such that a user can use the press portion as a fulcrum to apply a force to move the wrench handle and the control ring with respect to the driving head, and the two pawls are pushed by the smooth section of the control ring to release the fixed state of latching the ratchet section of the control ring.

2. The wrench of claim 1, wherein the accommodating portion further includes two grooves concavely disposed thereon, and ends of the two pawls are respectively and pivotally coupled into the two grooves, and other ends of the two pawls separately have brake teeth extended towards the axle hole, and an end of each first elastic element is abutted against the accommodating portion, and another end of each first elastic element is abutted against a side of the corresponding pawls without the brake teeth, so that the two pawls can provide a clamping action towards the axle hole.

3. The wrench of claim 1, wherein the smooth section of the control ring has an external diameter greater than the external diameter of the ratchet section.

4. The wrench of claim 1, wherein the wrench handle includes a penetrating hole formed at an end of the wrench handle and sheathed onto the connecting end of the control ring, and two fixing pins are passed into the wrench handle and the positioning slot of the connecting end respectively, such that the wrench handle is integrally coupled and linked with the control ring.

5. The wrench of claim 1, wherein the control ring is in a hollow ring shape, and a tapered neck and a positioning recession are defined from bottom to top at predetermined positions of the internal wall of the control ring, and a base is formed and expanded outward from an end of the prop column facing downward, and the prop column is fixed to the bottom of the axle hole of the driving head by the base, and a through hole is penetrated radially through the prop column, and two positioning blocks arranged in opposite directions are contained in the through hole, and a second elastic element is installed between the two positioning blocks for providing the two positioning blocks an elastic force towards the internal wall of the control ring, and when the ratchet section of the control ring is latched to the two pawls to define a fixed state, the two positioning blocks are latched to a tapered neck of the internal wall of the control ring, and when the control ring is driven synchronously by the wrench handle to release the fixed state of latching the ratchet section with the two pawls, the two positioning blocks are latched and abutted against the positioning recession of the internal wall of the control ring.

6. The wrench of claim 5, further comprising a third elastic element installed between the base and the control ring, and the elastic force provided by the second elastic element of the two positioning blocks is greater than the elastic force of the third elastic element.

7. The wrench of claim 5, wherein the base further includes a stop portion protruded from the base and accommodated into the bottom of the accommodating portion, such that when the prop column is fixed to the bottom of the axle hole of the driving head by the base, the stop portion of the base and the top of the accommodating portion are provided for stopping the two pawls to prevent the two pawls from being separated from the accommodating portion.

* * * * *